US010618532B2

(12) United States Patent
Zhang et al.

(10) Patent No.: US 10,618,532 B2
(45) Date of Patent: Apr. 14, 2020

(54) TRAIN COUPLER STRUCTURAL HEALTH MONITORING SYSTEM

(71) Applicants: JIAXING BROADSENS TECHNOLOGY, LTD., Jiaxing OT (CN); CRRC Zhuzhou Locomotive Co., Ltd., Zhuzhou OT (CN)

(72) Inventors: Chang Zhang, San Jose, CA (US); Lei Liu, San Ramon, CA (US); Xihong Jin, Zhuzhou (CN); Xining Li, Zhuzhou (CN); Xiangjian Yang, Zhuzhou (CN); Yanjun Zeng, Zhuzhou (CN); Yongqiang He, Zhuzhou (CN); Xing Xie, Zhuzhou (CN); Gang Yan, Zhuzhou (CN)

( * ) Notice: Subject to any disclaimer, the term of this patent is extended or adjusted under 35 U.S.C. 154(b) by 288 days.

(21) Appl. No.: 15/817,623

(22) Filed: Nov. 20, 2017

(65) Prior Publication Data

US 2018/0162423 A1 Jun. 14, 2018

Related U.S. Application Data

(60) Provisional application No. 62/432,692, filed on Dec. 11, 2016.

(51) Int. Cl.

| | |
|---|---|
| ***B61G 7/14*** | (2006.01) |
| ***B61G 5/06*** | (2006.01) |
| ***B61L 15/00*** | (2006.01) |
| ***B61L 1/20*** | (2006.01) |
| ***B61L 27/00*** | (2006.01) |
| ***B61G 3/00*** | (2006.01) |
| *B61L 23/00* | (2006.01) |

(52) U.S. Cl.

CPC ..... *B61G 7/14* (2013.01); *B61G 3/00* (2013.01); *B61G 5/06* (2013.01); *B61L 1/20* (2013.01); *B61L 15/0018* (2013.01); *B61L 15/0072* (2013.01); *B61L 15/0081* (2013.01); *B61L 27/0094* (2013.01); *B61L 23/00* (2013.01)

(58) Field of Classification Search

CPC ... B61G 5/00; B61G 5/06; B61G 7/00; B61G 7/10; B61G 7/12; B61G 7/14; B61L 15/00

See application file for complete search history.

(56) References Cited

U.S. PATENT DOCUMENTS 7,770,847 B1 * 8/2010 Severson ..... A63H 19/24 246/1 C

* cited by examiner

*Primary Examiner* — Robert J McCarry, Jr.
(74) *Attorney, Agent, or Firm* — Jigang Jin

(57) ABSTRACT

The present invention discloses a train coupler structural health monitoring system. The system includes one or more sensors mounted to or integrated with the train coupler, a data acquisition unit for receiving signal or data from the sensors, and a processing unit for determining the train coupler's structural health based on the received signal or data. Inspections via the system can be performed in real time continuously or periodically while a train is in service. It can also be performed offline while a train is not in service. Inspection method can be either passive, where sensors collect signals without generating excitation signals to the structure, or active, where some sensors are used as actuators to actively send excitation signals to the structure and other sensors or the actuators themselves collect the structural response signals. The data acquisition unit receives signals or data from sensors. The processing unit processes sensor data acquired by the data acquisition unit and determines if there are structural changes or damages.

18 Claims, 6 Drawing Sheets

TRAIN COUPLER STRUCTURAL HEALTH MONITORING SYSTEM

CROSS-REFERENCE TO RELATED APPLICATION

This application claims priority to U.S. provisional patent application Ser. No. 62/432,692, filed Dec. 11, 2016, the entire content of which is incorporated herein by reference.

FIELD OF INVENTION

This invention generally relates to the field of structural health monitoring ("SHM").

BACKGROUND OF THE INVENTION

A coupler is a structure for connecting cars of a train. Structural failure of couplers may cause accidents and sometimes lead to catastrophic damages, especially for heavy-load and high-speed trains. Therefore, it is critical to ensure that the couplers are in healthy structural condition. Cracks and metal fatigue are the most common structural failures for couplers. Currently, the inspections of coupler are performed offline during scheduled maintenance. The maintenance method is mainly through visual inspection. Since a significant part of the coupler is hidden beneath the car body, it often requires the disassembly of the coupler cover to perform the inspection. The inspection is very time consuming and labor intensive. In certain cases, since the damage happens internally, visual inspection will miss the hidden defect. Therefore, it is desirable to have a damage inspection system for train couplers that saves labor, improves efficiency, and increases accuracy.

SUMMARY OF THE INVENTION

The present invention discloses a structural health monitoring system for train couplers. The system detects both external and internal structural damages, including those in the part that is hidden beneath the car body, even when the train is in service.

In one embodiment, the train coupler structural health monitoring system includes one or more sensors mounted to or integrated with the train coupler, a data acquisition unit for receiving signal or data from the sensors, and a processing unit for determining the train coupler's structural health based on the received signal or data. Inspections via the system can be performed in real time continuously or periodically while a train is in service. It can also be performed offline while a train is not in service.

In one embodiment, inspections via the train coupler structural health monitoring system can be either passive, where sensors collect signals without generating excitation signals to the structure, or active, where some sensors are used as actuators to actively send excitation signals to the structure and other sensors or the actuators themselves collect the structural response signals, or the combination of passive and active sensors.

In another embodiment of the invention, a group of sensors are packaged inside one case to monitor an area of a train coupler. At least one of the sensors may function is an actuator and other sensors function as receivers. The shape of the case can be circular, rectangular, or any other shape.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the leftmost digit of a reference number identifies the drawing in which the reference number first appears.

DETAILED DESCRIPTION

Figure 1:
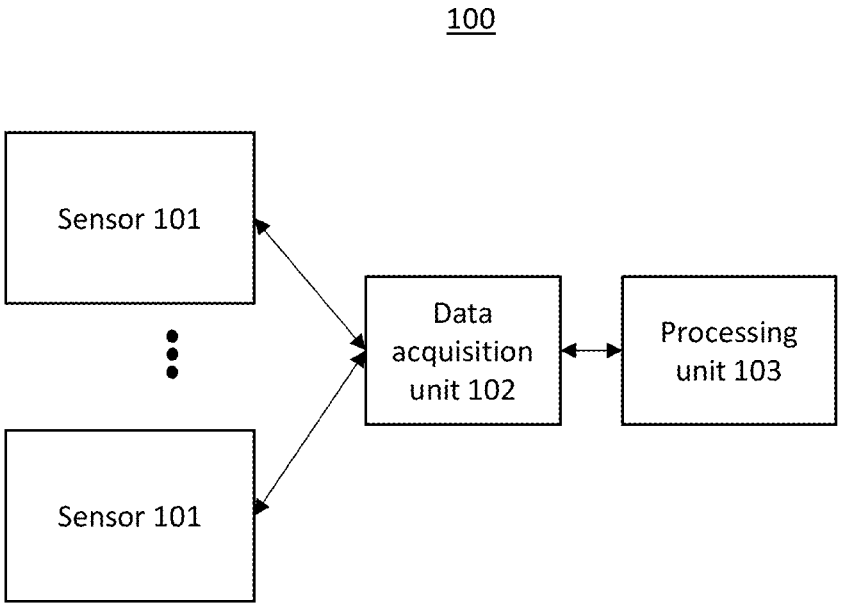
FIG. 1 is a simplified block diagram of a train coupler structural health monitoring system, according to one embodiment of the present invention.

This present invention discloses a structural health monitoring system 100 for train couplers. In one embodiment, as shown in FIG. 1, the system 100 comprises one or more sensors 101, a data acquisition unit 102 and a processing unit 103. Each sensor 101 may be an actuator, a receiver (i.e., passive sensor), or a combination of both (i.e., active sensor). Inspections via the system 100 can be performed in real time continuously or periodically while a train is in service. It can also be performed offline while a train is not in service. Inspection method can be passive, active, or the combination of both. In passive mode, sensors collect signals without generating excitation signals to the structure. In active mode, some sensors can be used as actuators, which actively send excitation signals to the structure, whereas other sensors or the actuators themselves collect the structural response signals. The data acquisition unit 102 receives signals or data from sensors 101. In active mode, the data acquisition unit 102 also generates actuation signals to actuators. The processing unit 103 processes sensor data acquired by the data acquisition unit 102 and determines if there are structural changes or damages.

The sensors 101 can be either mounted to the coupler or directly built in as part of the coupler. The mounting methods include epoxy, glues, screws, clamps, or other methods. The sensors 101 may have different sensing capabilities. For example, the sensors 101 can be piezoelectric sensors, EMAT (Electro Magnetic Acoustic Transducers), accelerators, gyroscopes, temperature sensors or fiber optic sensors. There may also be a combination of sensors with different sensing capabilities. Some sensors can also be used as actuators in the active mode.

The sensors 101, data acquisition unit 102, and/or processing unit 103 can be integrated together or separate devices. For example, the data acquisition unit 102 may be integrated with some sensors 101 as a single device. As another example, the data acquisition unit 102 may be integrated with the processing unit 103 as a single device. But when the amount of data to be processed is huge or certain complex data processing algorithm (e.g., artificial intelligence, machine learning) is needed, a remote (e.g., cloud-based) and more powerful processing unit 103 may be used instead.

The data acquisition unit 102 can connect to the sensors 101 either by wires or wirelessly. When the connection is wired, the wires can be but are not limited to shielded, unshielded, coaxial or twisted-pair, USB cable, Ethernet cable, or other connections. When the connection is wireless, the wireless mode can be but are not limited to ZigBee, Wi-Fi, or mobile data network. Signals or data transferred between sensors 101 and data acquisition unit 102 can be analog or digital.

The processing unit 103 can connect to the data acquisition unit 102 either by wires or wirelessly. When the connection is wired, the wires can be but are not limited to USB cable, Ethernet cable, CAN, RS485, or other connections. When the connection is wireless, the wireless mode can be but are not limited to ZigBee, Wi-Fi, Lora, Z wave, Bluetooth, or mobile data network.

Figure 2:
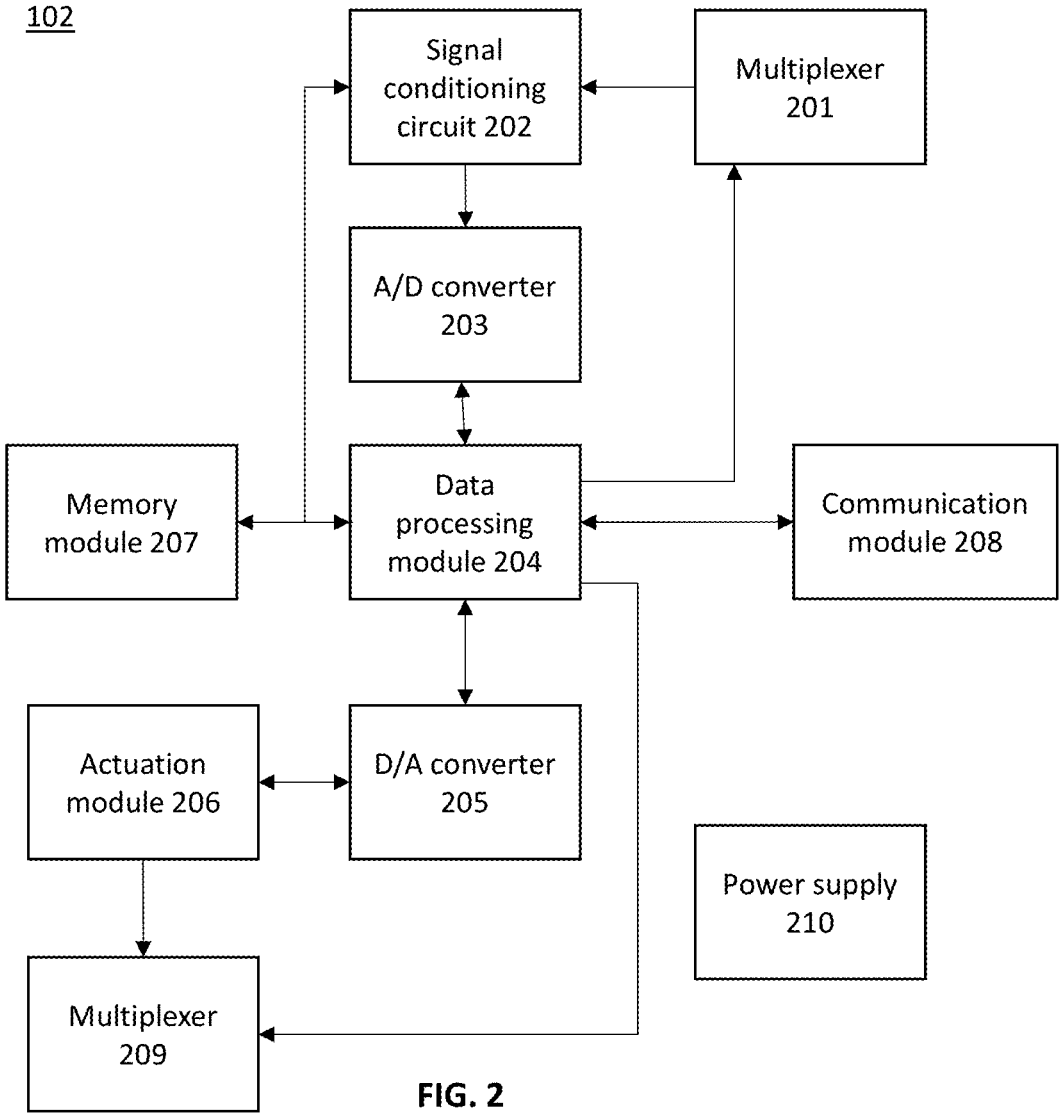
FIG. 2 is a simplified block diagram of a data acquisition unit of a train coupler structural health monitoring system, according to one embodiment of the present invention.

As shown in FIG. 2, the data acquisition unit 102 may include a multiplexer 201 for listening signals from multiple sensors, a signal conditioning circuit 202 that amplifies signal level and filter out unwanted environment noise, an A/D converter 203 that converts analog signals to digital signals, a data processing module 204 that processes signals through digital filtering or feature extraction, a D/A converter 205 that converts digital signals to analog signals, an actuation module 206 that generates actuation signals and sends the signals to the actuators, a memory module 207 that stores data, a communication module 208, a multiplexer 209 for choosing from multiple actuators for sending the actuation signals, and a power supply 210 for supplying power to the various components described above. Note that the data acquisition unit 102 may have various configurations, where certain components are optional.

In one embodiment, the communication module 208 connects with a remote-control center so that the data acquisition unit 102 could be remoted configured from the control center. In addition, the communication module 208 may also supports communications between the data acquisition unit 102 with digital sensors. Such communications could be achieved via USB, Ethernet, ZigBee, CAN, Wi-Fi, mobile data network, or other digital connection method.

In another embodiment, the data acquisition unit 102 and the processing unit 103 are integrated as a single device. In this case, the data processing module 204 could be replaced by the processing power of the processing unit 103.

Note that multiplexer 201 and multiplexer 209 may be combined into one multiplexer module which is controlled by the data processing module 204 in terms of which sensor or actuator is chosen for receiving signals from or sending excitation signals to.

The sensors 101, the data acquisition unit 102, and/or the processing unit 103 may each have a built-in battery. To make the device self-sufficient, an energy harvesting circuit can also be added to harvest the energy when the train is in operation. The energy can be harvested by using piezoelectric sensors that convert mechanical energy from the train vibration/movement into electrical energy.

In one embodiment of the invention, accelerators, gyroscopes, position sensors, displacement sensors, and/or magnetometer are used to measure the movement of some parts of the coupler while the train is in service. When there is a damage, the movement of the parts will behave differently and therefore produces some different features. For example, in the frequency domain, the frequency response of a damaged part may be different from that of a normal one. By examining the signal change in the time domain and frequency domain, one can identify the potential damage. Specifically, when a draft gear or buffer gear is malfunctioning, the moving distance of the train coupler is different from the normal situation.

In another embodiment of the invention, temperature sensors are used to monitor the temperature change at some critical parts. For example, when the jaw of a train coupler is close to the broken stage due to metal fatigue, the temperature of the jaw area can rise higher. The temperature sensors are not necessarily mounted directly to the targeted area. An infrared temperature sensor can be used to monitor the temperature change.

In one embodiment of the invention, strain sensors or load sensors are used to monitor the load of a train coupler. When the load exceeds a certain level, the train coupler could be pushed to breaking point. The strain and load can also be used with other data such as acceleration and position to calculate the status of the draft gear.

Figure 3A:
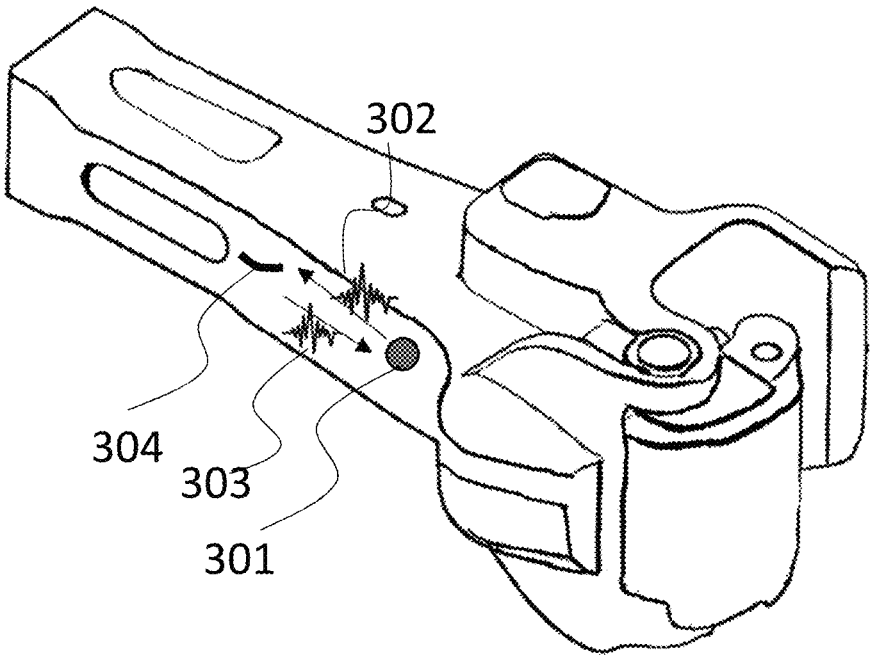
FIG. 3A illustrates an example of using ultrasonic sensors to monitor the structural health of a train coupler, according to one embodiment of the present invention.
Figure 3B:
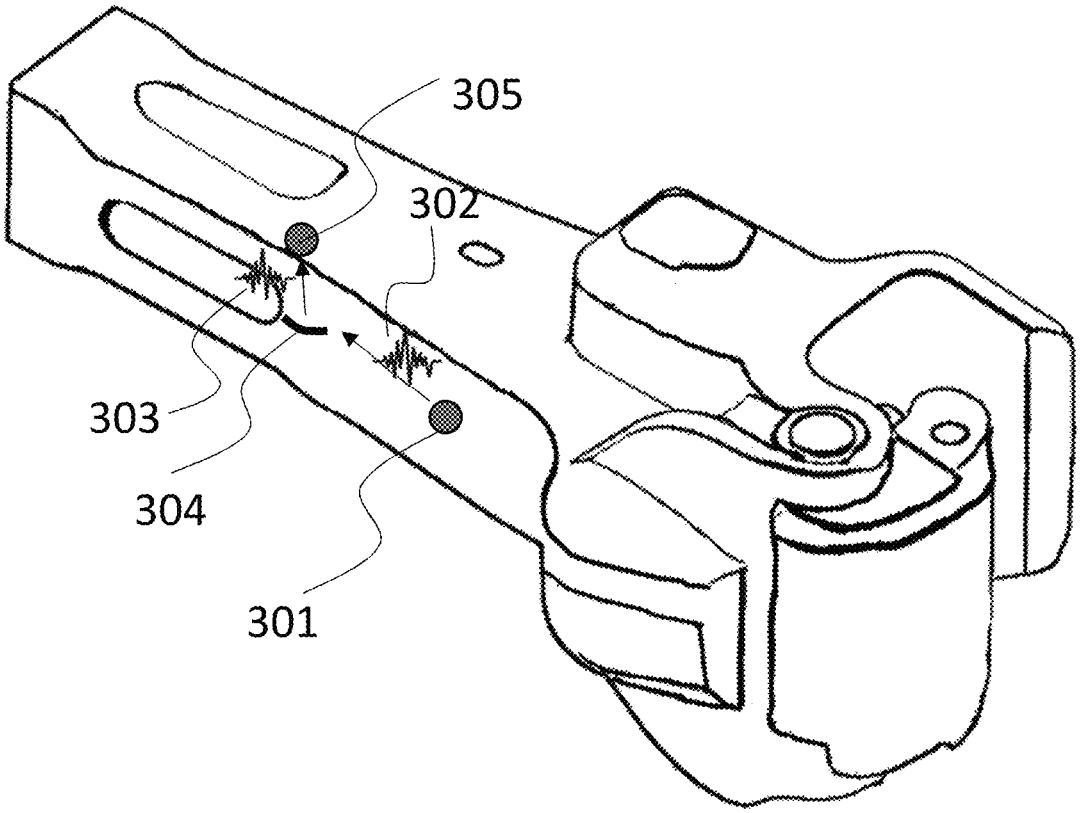
FIG. 3B illustrates another example of using ultrasonic sensors to monitor the structural health of a train coupler, according to one embodiment of the present invention.

In another embodiment of the invention, ultrasonic sensors (e.g., piezoelectric sensors, EMAT) are used to inspect the structural health. FIG. 3A illustrates such an example where an ultrasonic sensor 301 is used to detect a crack 304 in a train coupler. The data acquisition unit 102, which is installed nearby, generates excitation signals and sends the excitation signals to the sensor 301. The excitation signals can be pulse or lamb wave signals. The ultrasonic sensor 301 converts the electric signals to mechanic waves 302 that travel through the surface and interior of the coupler. The ultrasonic sensor 301 picks up the reflection of the waves 303 and convert them back to electric signals. FIG. 3B illustrates another example where another ultrasonic sensor 305 picks up the waveform 303 reflected off the crack 304 and converts it back to electric signals.

In another embodiment of the invention, a plurality of sensors can be used for forming a mesh network to cover a target area. When the target coupler is in normal structural health, the waveforms are used as a baseline. When there is a crack or other type of damage, the waveforms will be different from the baseline. By analyzing the change of the waveforms, the location and size of the crack can be identified.

Figure 4:
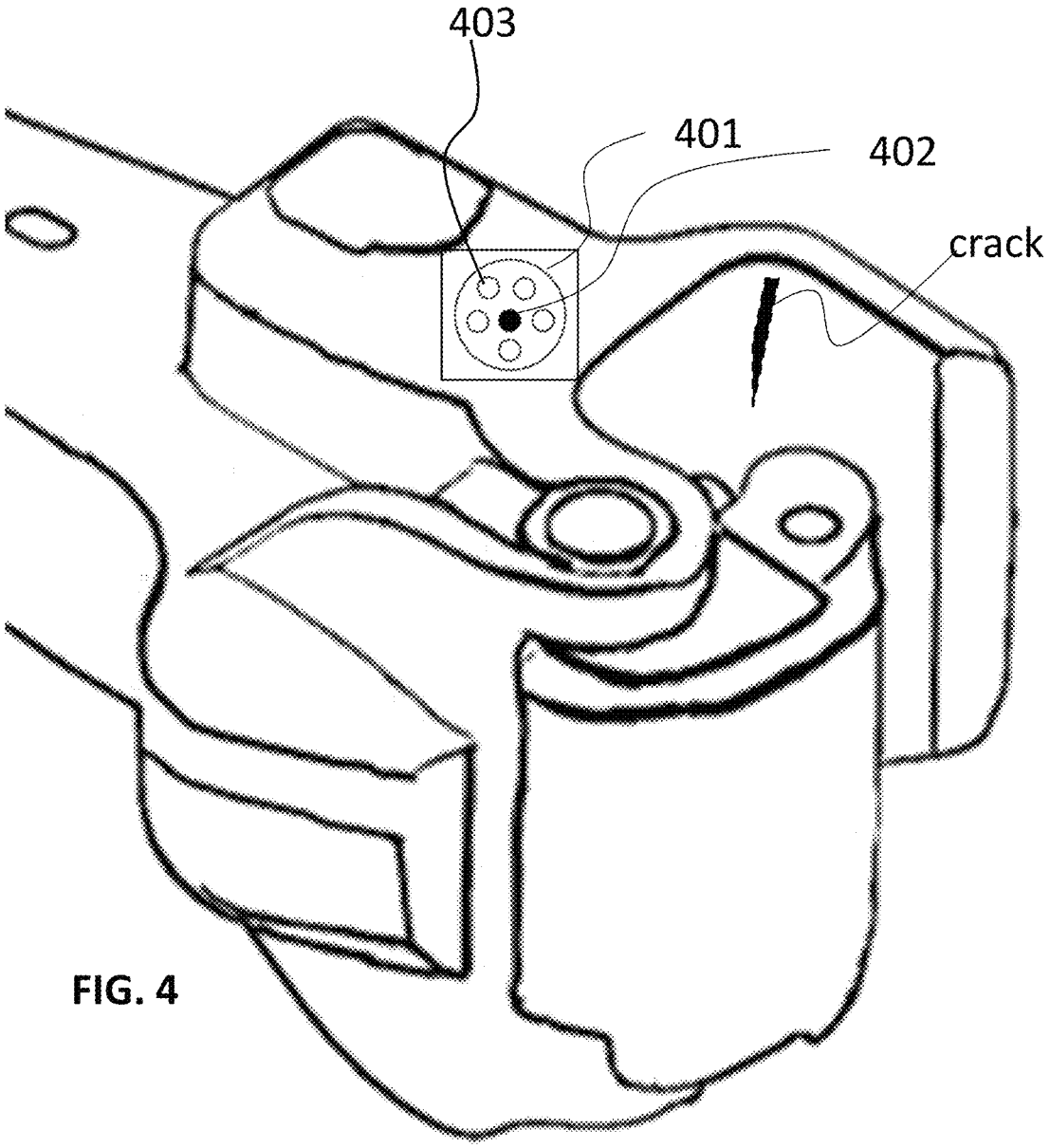
FIG. 4 illustrates an example of using a plurality of sensors packaged in a case to monitor the structural health of a train coupler, according to one embodiment of the present invention.
Figure 5:
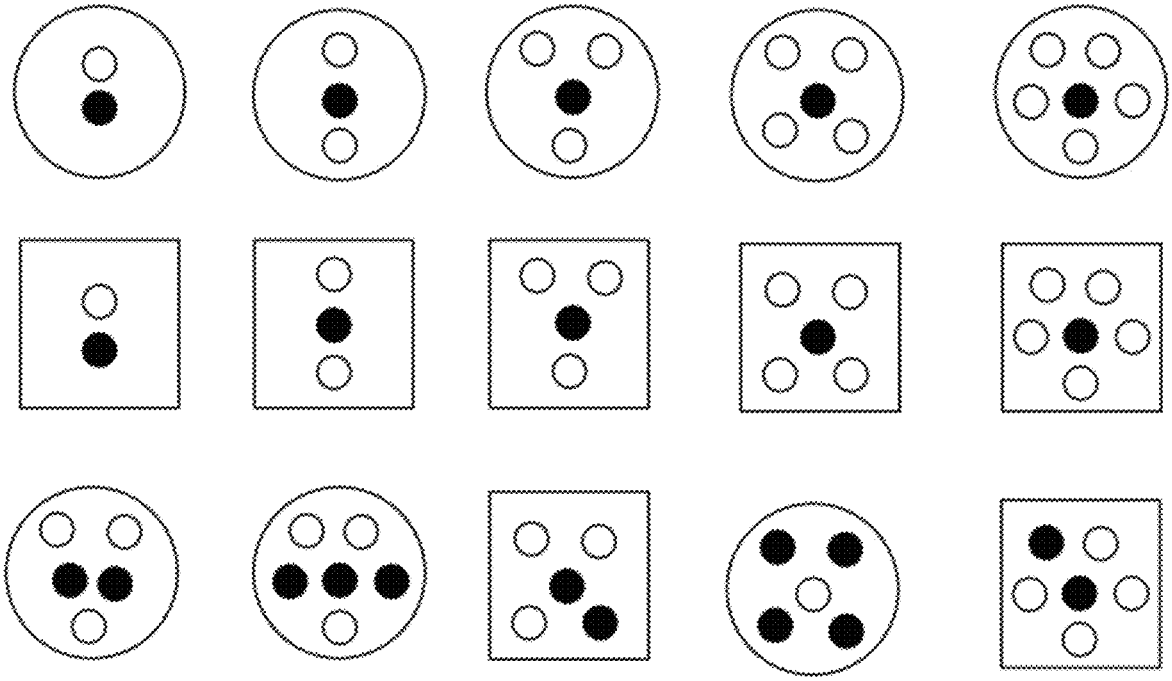
FIG. 5 illustrates various examples of an array of sensors in a package, according to one embodiment of the present invention.

FIG. 4 illustrates an example where a group of sensors 402 and 403 are packaged inside one case 401 to monitor an area of a train coupler. This is especially useful when one cannot mount the sensors in an area that can have potential damage. For example, to monitor the integrity of the internal area of the coupler head, one can put the sensor group in an area that has clearance. There is at least one sensor 402 used as a transmitter and at least one of the sensors 403 used as a receiver in this case. As shown in FIG. 5, the shape of the case 401 can be circular, rectangular, or any other shape.

In another embodiment of the invention, a temperature sensor is attached to a train coupler to gather environment information for the calibration purpose. Since the structure response is affected by temperature, so that temperature measurement is used to get the structure response at different temperature level for more accurate damage detection. The temperature type can be but are not limited to Resistance Temperature Detector (RTD), thermocouple or semiconductor-based sensors.

The data acquisition unit 102 and/or the processing unit 103 may include a memory module, which saves the acquired data and processed result. The data acquisition unit 102 and/or the processing unit 103 may include a communication module for network connection. The connection can be but are not limited to USB, Ethernet, ZigBee, CAN, Wi-Fi, mobile data network, or other connection method.

The system 100 may also include a remote management console for sending instructions to the data acquisition units and/or the processing units to coordinate these units and receiving data and/or structural health results from these units over a network.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

The invention claimed is:

1. A structural health monitoring system for a train coupler, the system compromising:

a plurality of ultrasonic sensors, which are mounted to or integrated with the train coupler;

a data acquisition unit for working with the plurality of ultrasonic sensors to send pulse or lamb wave excitation signals to the train coupler and collect response signals from the train coupler; and a processing unit for determining whether the train coupler has a crack based on the collected response signals.

2. The system of claim 1, wherein said data acquisition unit sends excitation signals to the train coupler through at least one said ultrasonic sensors and collects a response from the train coupler through at least one said ultrasonic sensors.

3. The system of claim 1, wherein said plurality of ultrasonic sensors are built in as part of the train coupler.

4. The system of claim 1, wherein said plurality of ultrasonic sensors are mounted to the train coupler in-situ by means of epoxy, clamps, glue, screws, or other mounting means.

5. The system of claim 1, wherein said plurality of ultrasonic sensors comprises piezoelectric sensors.

6. The system of claim 1, wherein said plurality of ultrasonic sensors and said data acquisition unit are integrated as a single device.

7. The system of claim 1, wherein said plurality of ultrasonic sensors are connected to said data acquisition unit with wires or wirelessly.

8. The system of claim 1, wherein said data acquisition unit and said processing unit are integrated as a single device.

9. The system of claim 1, wherein said data acquisition unit are connected to said processing unit with wires or wirelessly.

10. The system of claim 1, wherein said plurality of ultrasonic sensors are powered by said data acquisition unit.

11. The system of claim 1, wherein said plurality of ultrasonic sensors are powered by a battery.

12. The system of claim 11, wherein said battery is charged by an energy harvesting circuit.

13. The system of claim 1, wherein said data acquisition unit is powered by a built-in battery.

14. The system of claim 13, wherein said battery is charged by an energy harvesting circuit.

15. The system of claim 1, wherein said processing unit is powered by a built-in battery.

16. The system of claim 15, wherein said battery is charged by an energy harvesting circuit.

17. The system of claim 1, wherein an alarm is generated when a crack in the train coupler is detected.

18. The system of claim 1, further includes a remote management console for sending instructions to the data acquisition unit and the processing unit to coordinate these units and for receiving data and structural health results from these units over a network.

* * * * *